US009163382B2

(12) United States Patent
Fraley et al.

(10) Patent No.: US 9,163,382 B2
(45) Date of Patent: Oct. 20, 2015

(54) GEARBOX LOCK MECHANISM

(71) Applicant: King Kutter, Inc., Winfield, AL (US)

(72) Inventors: J. Phillip Fraley, Winfield, AL (US); John W. Davis, III, Winfield, AL (US)

(73) Assignee: King Kutter, Inc., Winfield, AL (US)

( * ) Notice: Subject to any disclaimer, the term of this patent is extended or adjusted under 35 U.S.C. 154(b) by 92 days.

(21) Appl. No.: 14/157,236

(22) Filed: Jan. 16, 2014

(65) Prior Publication Data

US 2014/0197004 A1 Jul. 17, 2014

Related U.S. Application Data

(60) Provisional application No. 61/753,307, filed on Jan. 16, 2013.

(51) Int. Cl.

| | |
|---|---|
| ***E21B 19/00*** | (2006.01) |
| ***E02F 9/20*** | (2006.01) |
| ***E21B 17/02*** | (2006.01) |
| ***E21B 7/02*** | (2006.01) |

(Continued)

(52) U.S. Cl.

CPC . *E02F 9/202* (2013.01); *E02F 3/06* (2013.01); *E21B 7/02* (2013.01); *E21B 17/02* (2013.01); *E21B 19/18* (2013.01)

(58) Field of Classification Search

CPC ..... A01C 5/04; A01K 97/01; E02F 3/06; E02F 9/202; E21B 3/06; E21B 3/045; E21B 7/008; E21B 7/021; E21B 7/02; E21B 7/028; E21B 7/005; E21B 10/44; E21B 17/003; E21B 17/22; E21B 17/046; E21B 19/028; E21B 19/16; E21B 19/18; F25C 5/04

USPC ..... 172/111; 173/26, 39, 146; 175/18, 394, 175/320, 323, 408, 424, 121, 145, 160, 175/162; 299/87.1

See application file for complete search history.

(56) References Cited

U.S. PATENT DOCUMENTS

| | | | | |
|---|---|---|---|---|
| 1,622,704 A * | 3/1927 | Coil | ..... | 173/26 |
| 1,951,192 A | 3/1934 | Hantjopoulos | | |
| 2,273,203 A | 2/1942 | Keene et al. | | |

(Continued)

FOREIGN PATENT DOCUMENTS

| | | |
|---|---|---|
| WO | 2010/025500 A1 | 3/2010 |
| WO | 2012/031108 A1 | 3/2012 |

OTHER PUBLICATIONS

International Search Report and Written Opinion mailed Feb. 1, 2012 in International Application No. PCT/US2011/050189, 14 pages.

*Primary Examiner* — Robert Pezzuto

(74) *Attorney, Agent, or Firm* — Angela Holt; Bradley Arant Boult Cummings LLP

(57) ABSTRACT

The gearbox lock mechanism for a post bole auger has a collar coupled to a lower end of a right angle gearbox, the collar rotatable upon operation of the gearbox. The collar comprises a semi-circular outer edge and a flat side. A male-threaded nipple extends from the collar and threads onto the auger shaft. A lock bar is coupled to the gearbox and acts as a positive lock to lock the collar in place for removal of the shaft from the gearbox. The lock bar is rotatable from a locked position whereby the lock bar is aligned with and contactable with the flat side of the outer edge of the collar, to an unlocked position whereby the lock bar does not contact the flat side of the outer edge of the collar.

18 Claims, 5 Drawing Sheets

(51) Int. Cl.
*E21B 19/18* (2006.01)
*E02F 3/06* (2006.01)

(56) References Cited

U.S. PATENT DOCUMENTS

| | | | | | |
|---|---|---|---|---|---|
| 2,320,610 | A | | 6/1943 | Kandle | |
| 2,401,250 | A | | 5/1946 | Kandle | |
| 2,838,285 | A | | 6/1958 | Gredell | |
| 2,890,860 | A | * | 6/1959 | Smith | 173/140 |
| 2,912,228 | A | | 11/1959 | Kandle | |
| 3,093,199 | A | | 6/1963 | Premo | |
| 3,235,018 | A | | 2/1966 | Troeppl | |
| 3,375,890 | A | | 4/1968 | Petersen | |
| 3,710,877 | A | | 1/1973 | Michasiw | |
| 3,902,562 | A | | 9/1975 | Pessier et al. | |
| 3,998,283 | A | | 12/1976 | Chitwood et al. | |
| D267,405 | S | | 12/1982 | Wilson | |
| 4,819,744 | A | | 4/1989 | Caswell | |
| 5,507,354 | A | * | 4/1996 | Harleman | 175/162 |
| 5,820,319 | A | | 10/1998 | Hull et al. | |
| 6,151,810 | A | * | 11/2000 | Mukai | 37/350 |
| 6,216,803 | B1 | | 4/2001 | Deken | |
| 6,655,476 | B2 | | 12/2003 | Groce, Jr. et al. | |
| 6,725,950 | B2 | * | 4/2004 | Palm | 175/162 |
| 7,036,606 | B2 | * | 5/2006 | Rossi | 173/28 |
| 7,210,543 | B1 | * | 5/2007 | Sumner | 175/323 |
| 7,699,119 | B1 | * | 4/2010 | Lunde et al. | 175/18 |
| 2012/0048624 | A1 | | 3/2012 | Fraley et al. | |
| 2013/0014997 | A1 | | 1/2013 | Fraley et al. | |

* cited by examiner

GEARBOX LOCK MECHANISM

CROSS REFERENCE TO RELATED APPLICATIONS

This application claims the benefit of U.S. Provisional Application No. 61/753,307 filed on Jan. 16, 2013, the entire contents of which are herein incorporated by reference.

BACKGROUND AND SUMMARY

A post hole digger attaches to the standard three point hitch of the tractor is powered by the tractor's power take-off (PTO). The digger comprises an auger without protrusions or other extending parts above the fighting of the auger, to reduce the possibility of a user becoming ensnared during use of the digger.

A gearbox translates rotation from the PTO shaft to the auger. In a traditional post hole digger, the auger's shaft attaches to the gearbox via a cross bolt that extends perpendicularly through the shaft. The cross bolt has the disadvantage of protruding from the shaft, and causing potential harm to a user. The digger of the present disclosure removes this disadvantage by providing a threaded fitting between the shaft and the gearbox. However, a threaded fitting on the rotating shaft provides an additional challenge When the auger needs to be removed from the gearbox.

The gearbox lock mechanism of the present disclosure comprises a collar coupled to a lower end of the gearbox, the collar rotatable upon operation of the gearbox. The collar comprises a semi-circular outer edge and a flat side. A male-threaded nipple extends from the collar and threads into the auger shaft. A lock bar is coupled to the gearbox and acts as a positive lock to lock the collar in place for removal of the shaft from the gearbox. The lock bar is rotatable from a locked position whereby the lock bar is aligned with and contactable with the flat side of the outer edge of the collar, to an unlocked position whereby the lock bar does not contact the flat side of the outer edge of the collar.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein.

BRIEF DESCRIPTION OF THE DRAWINGS

The disclosure can be better understood with reference to the following drawings. The elements of the drawings are not necessarily to scale, emphasis instead being placed upon clearly illustrating the principles of the disclosure. Furthermore, like reference numerals designate corresponding parts throughout the several views.

DETAILED DESCRIPTION

Figure 1:
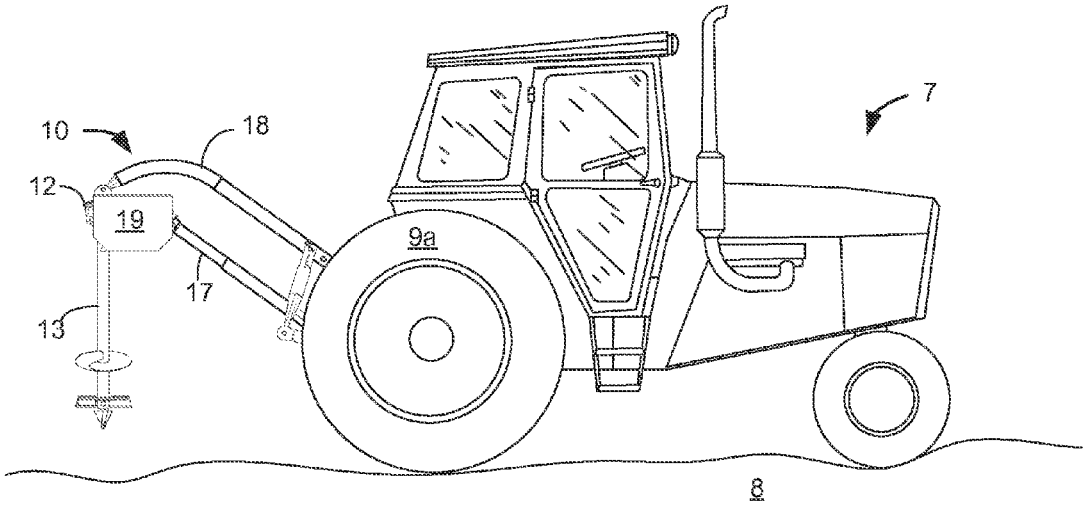
FIG. 1 is a side plan view of a post hole digger coupled to a tractor.

FIG. 1 is a side plan view of a post hole digger 10. The digger 10 is shown installed on a tractor 7 and is used to dig generally-cylindrical holes (not shown) in the ground 8, for example, holes for fence posts. The digger 10 is disposed at the rear of the tractor 7 between the rear wheels 9*a* and 9*b* (FIG. 2) of the tractor 7.

The digger 10 comprises an auger 13 for drilling into the ground 8. The digger 10 is disclosed in U.S. Non-Provisional Patent Application Serial No. 13/548,836, titled "Post Hole Digger," published on Jan. 17, 2013, under Publication No. US-2013-0014997-A1, which is incorporated herein by reference in its entirety.

The auger 13 is supported by a top support arm 18 that extends from the tractor 7. A rotating shaft 17 extends from a PTO shaft 20 (FIG. 2) of the tractor 7 and translates rotation from the PTO shaft 20 to a gearbox 12, and ultimately to the auger 13. A shield 19 covers moving parts (not shown) of the gearbox 12 that could otherwise pose a safety hazard to users not shown) of the digger 10.

Figure 2:
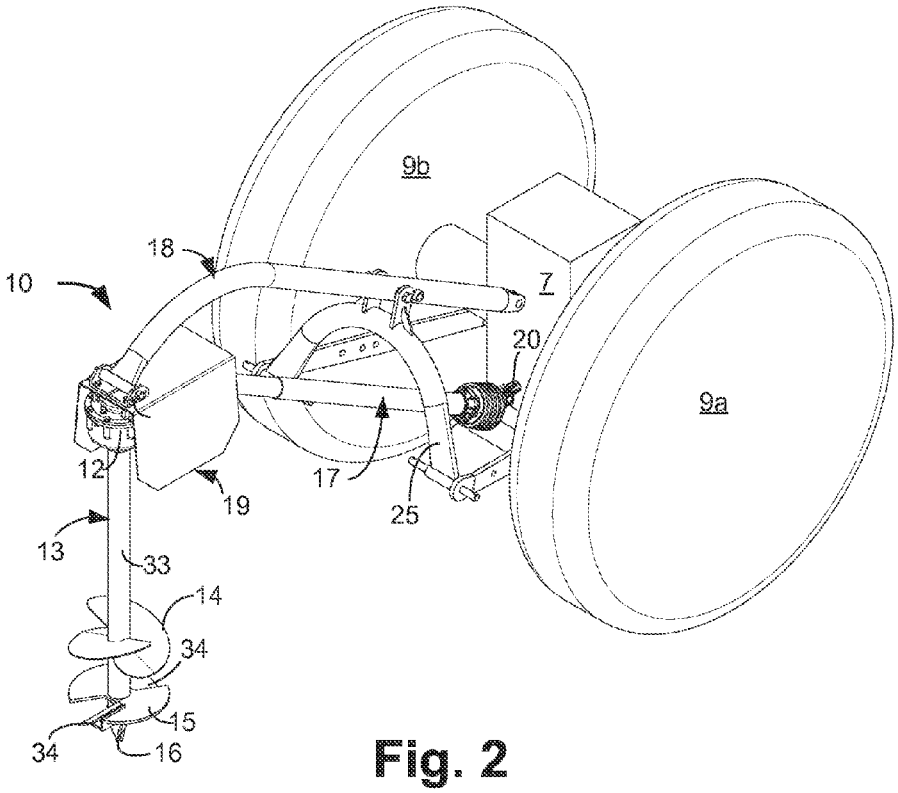
FIG. 2 is a rear perspective view of the post hole digger of FIG. 1.

FIG. 2 is a rear perspective view of the digger 10 installed on the tractor 7 between the rear wheels 9*a* and 9*b* of the tractor 7. The digger 10 connects to the tractor's standard three point hitch that is known in the art. The term "three point hitch" refers to the three mounting points of a tractor hitch that extend rearwardly from the rear of the tractor 7.

The top support arm 18 is rotatably affixed to the shield 19 that covers the gearbox 12. A support frame 25 supports the top support arm 18. The shield 19 is rigidly affixed to the gearbox 12, and is not detachable from the digger in this embodiment without making the digger non-fictional, to provide safety for the user.

The rotating shaft 17 is releasably coupled to the PTO shaft 20 of the tractor 7. As known by persons of skill in the art, a power-take off shaft is a splined shaft that is rotatable by the user (not shown) upon actuation of the tractor controls (not shown). Rotation of the PTO shaft 20 typically powers farming implements such as the digger 10. The rotating shaft 17 extends from the PTO shaft 20 to the gearbox 12, as further discussed herein.

The gearbox 12 is a right angle gearbox that receives rotation from the rotating shaft 17 and translates the received rotation to the auger 13. In this embodiment, the auger 13 comprises a rotatable auger shaft 33, a plurality of fighting blades 14 and a cutting head 15. The cutting head 15 is disposed at the lowermost end of the shaft 33, and comprises a pilot bit 16 and a pair of cutting blades 34. The fighting blades 14 are disposed above the cutting head 15.

The outer surface of the shaft 33 is generally smooth above the fighting blades 14, and has no protrusions or other irregularities above the fighting blades 14 that may ensnare or entangle a user during use. This is an improvement over prior art augers which contain protrusions from the shaft that can endanger a user.

Figure 3:
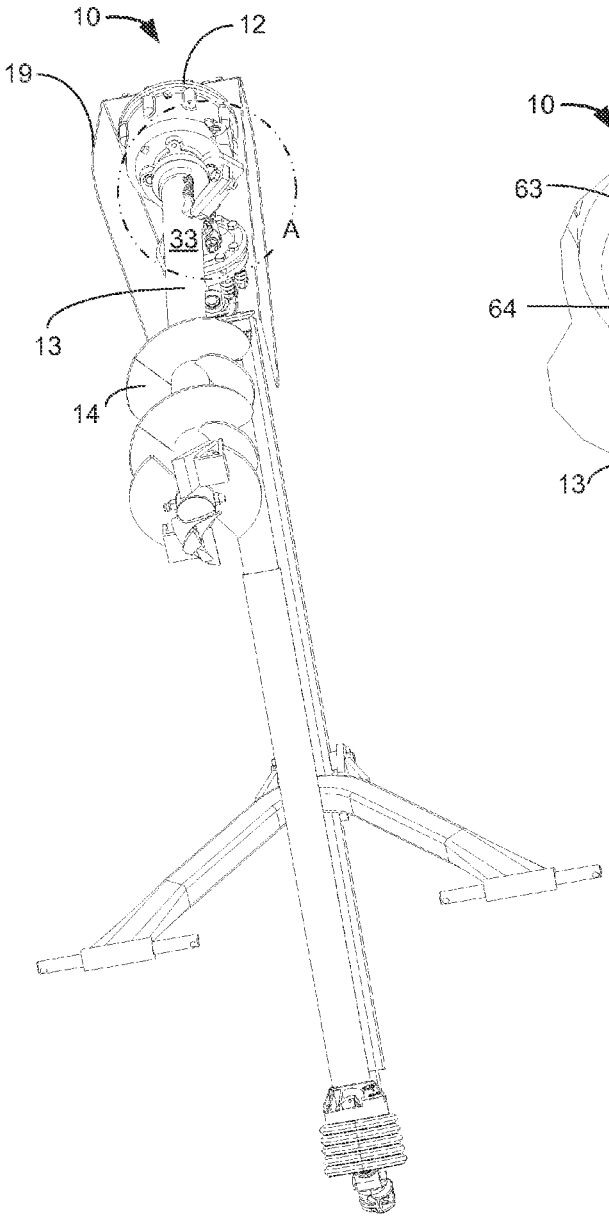
FIG. 3 is a bottom perspective view of the digger.

FIG. 3 is a bottom perspective view of the digger 10. The gearbox 12 is disposed beneath the shield 19, The auger 13 comprises a shaft 33 that extends from the gearbox 12. Between the gearbox 12 and the flighting 14, the shaft 33 is smooth, i.e., has no protrusions that could catch on a user or the user's clothing.

Figure 4:
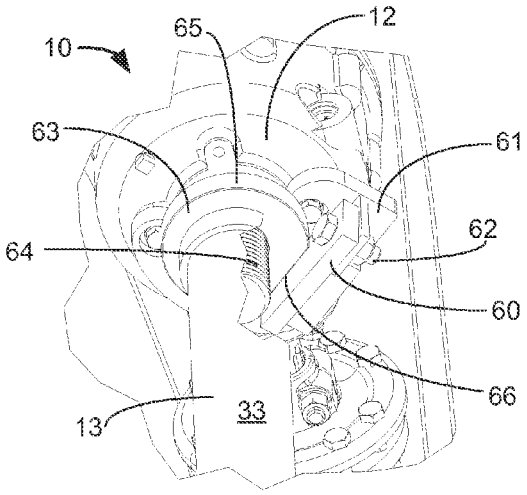
FIG. 4 is an enlarged detail view of the digger of FIG. 3, taken along detail line A of FIG. 3.

FIG. 4 is an enlarged detail view of the digger 10 of FIG. 3, taken along detail "A" of FIG. 3. A collar 63 extends beneath the gearbox and is rigidly affixed to a male-threaded nipple 64 that releasably affixes the shaft 33 to the gearbox 12. In the illustrated embodiment the collar 63 is unitary with the nipple 64. The collar has a semi-circular outer edge 65 that is primarily semi-circular and has a flat side 66. The collar 63, threads 64 and shaft 33 rotate when the digger 10 (FIG. 1) is in operation.

A lock bar support 61 is coupled to the gearbox 12 between the collar 63 and the gearbox 12. The lock bar support 61 does not rotate. A lock bar 60 is rotatably coupled to the lock bar support 61 via a fastener 62.

When the digger 10 is in operation, the lock bar 60 is in an "unlocked" position such that the lock bar 60 extends downwardly. When the user desires to remove the auger 13 (FIG. 3) from the gearbox 12, the user manually moves the lock bar 60 to a "locked" position such that the lock bar 60 is rotated upwardly until it contacts the lock bar support 61. In this orientation, the lock bar 60 is generally parallel to the flat side 66 of the collar 63. When the lock bar 60 is in the locked position, the flat side 66 contacts the lock bar 60 and prevents the collar 63 from rotating. Thus the term "locked" refers to the collar 63 being locked such that it cannot rotate, and the term "unlocked" refers to the collar being rotatable. When the collar 63 is locked, the user can remove the auger 13 from the digger 10 by unscrewing the shaft 33 from the threaded nipple 64.

Figure 5:
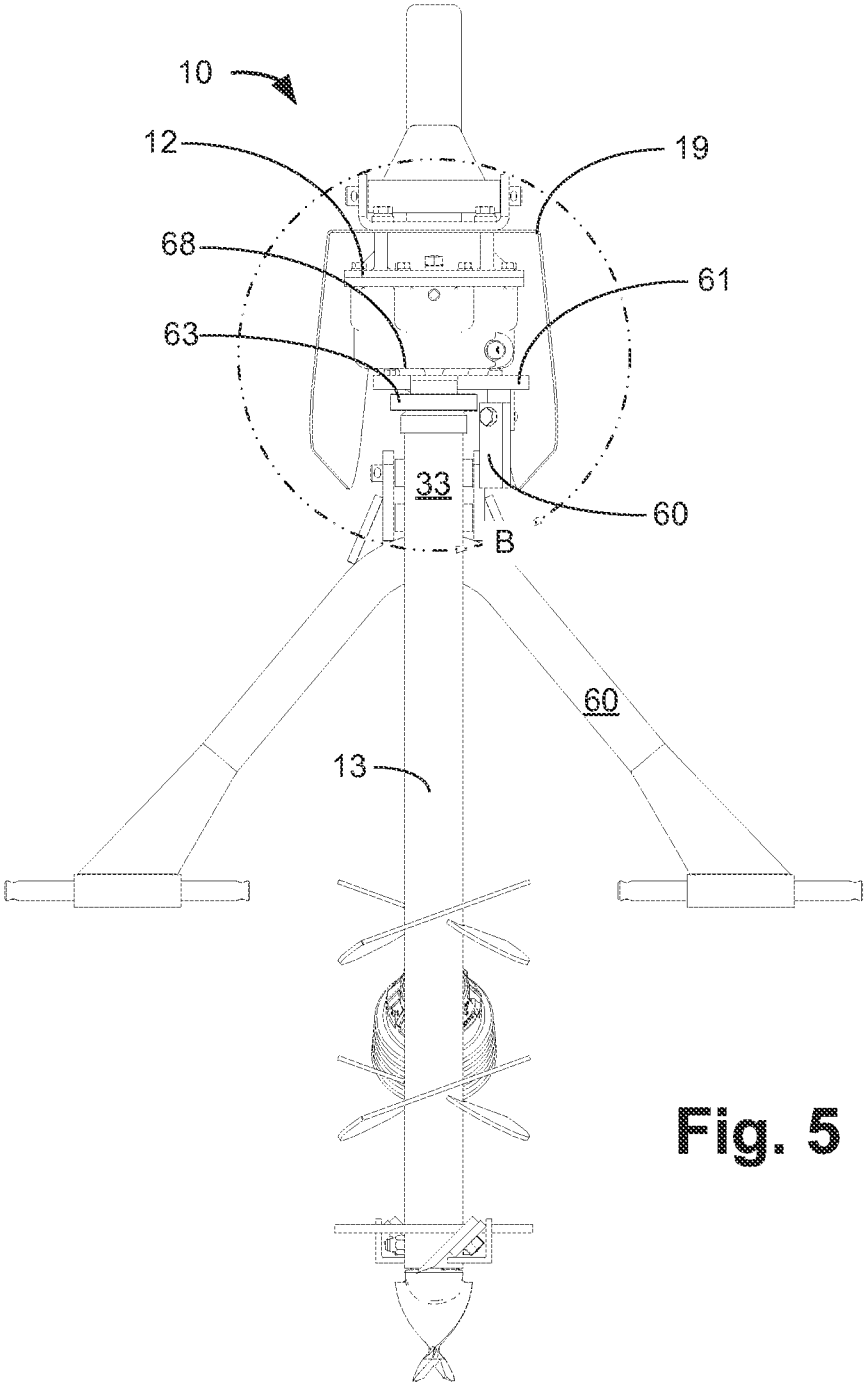
FIG. 5 is a rear plan view of the digger of FIG. 1.

FIG. 5 is a rear plan view of the digger 10 of FIG. 1. The lock bar support 61 is rigidly coupled to a bottom side 68 of the gearbox 12. In one embodiment, the lock bar support 61 is affixed to the gearbox 12 via a plurality of fasteners (not shown). The lock bar support 61 is generally parallel to the collar 63. The lock bar 60 extends downwardly from the lock bar support 61 when the lock bar 60 is in its unlocked position, as shown. In this unlocked position, the lock bar 60 is generally perpendicular to the lock bar support 61 and the collar 63.

Figure 6:
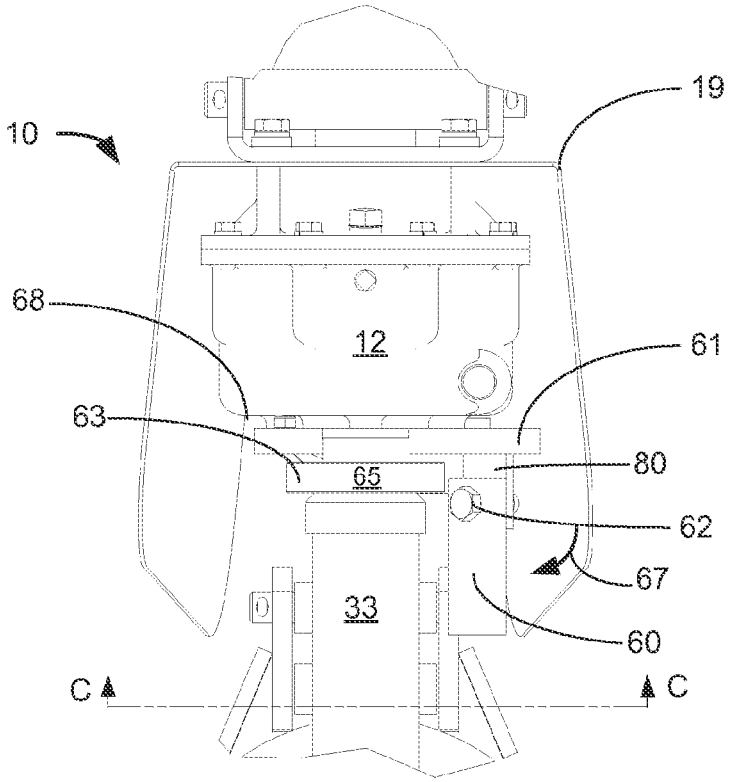
FIG. 6 is an enlarged detail view of the digger of FIG. 5, taken along detail line B of FIG. 5.

FIG. 6 is an enlarged detail view of the digger 10 of FIG. 5, taken along detail line "B" of FIG. 5. The lock bar 60 is shown in its unlocked position. From this unlocked position, the lock bar 60 is rotatable upwardly in the directly indicated by directional arrow 67. The lock bar 60 is generally rectangular, with long opposed sides extending downwardly when it is in the unlocked position.

The lock bar support 61 is comprised of a generally fiat support plate 82 and a downwardly extending tab 80 that is generally perpendicular to the support plate 82. The lock bar 60 is rotatably affixed to the tab 80 via the fastener 62, which may be a bolt and nut. The support plate 82 and tab 80 are made of steel in one embodiment, though other suitably strong and rigid materials could be used.

Figure 7:
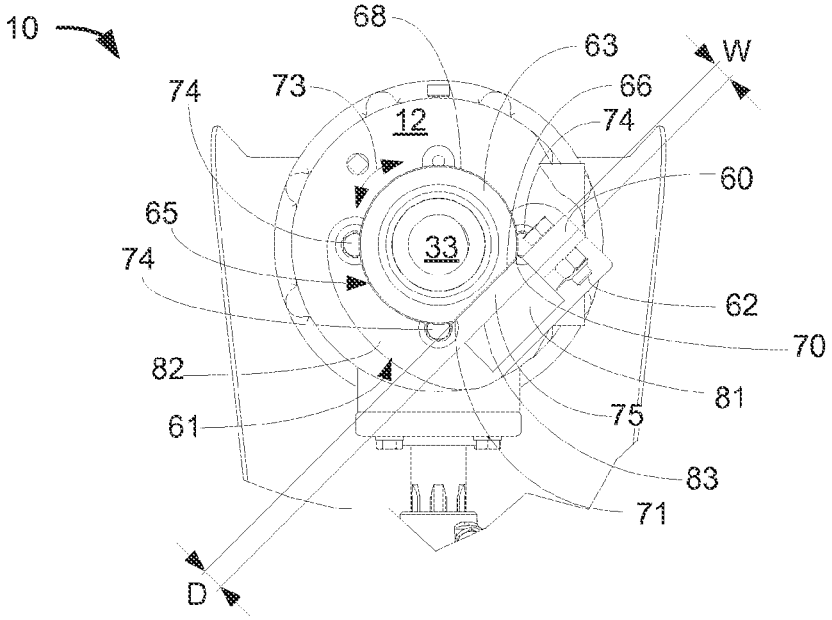
FIG. 7 is a cross sectional view of the digger of FIG. 6, taken along section lines C-C of FIG. 6.

FIG. 7 is a cross sectional view of the digger 10 of FIG. 6, taken along section lines C-C of FIG. 6, with the lock bar 60 shown in its unlocked position. In this position, the lock bar 60 cannot contact the collar 63, thus the collar 63 is free to rotate. The support plate 82 of the lock bar support 61 is a curved plate with a generally flat cross section and is coupled to the gearbox 12 via a plurality of fasteners 74. Note that the support plate 82 is coupled to the non-rotatable outer body of the gearbox 12, in contrast with the collar 63, which rotates upon operation of the gearbox 12. The support plate 82 extends over halfway around the gearbox 12 when viewed from the bottom as shown.

The lock bar support 61 further comprises a block stop 81 that is rigidly affixed to the support plate 82 adjacent to the lock bar 60 when the lock bar 60 is in the locked position. The block stop 81 comprises a generally rectangular box, generally made of steel, that is substantially parallel to and spaced apart from the flat side 66 of the collar 63 when the collar 63 is locked. The block stop 81 being spaced apart from the flat side 66 creates a gap 75 between the block stop 81 and flat side 66. The width of this gap 75, i.e., the distance "D" between an inner surface 83 of the block stop 81, is slightly larger than a width "W" of the lock bar 60. This is desired because when the lock bar 60 is locked, it is disposed between the inner surface 83 of the block stop 81 and the flat side 66 of the collar 63.

The outer edge 65 of the collar 63 comprises the flat side 66 and a semi-circular portion 68 that extends more than 270 degrees around the collar. In other words, the flat side 66 in effect "cuts off" the outer edge 65, generally less than 90 degrees around the outer edge 65. Corners 70 and 71 on the outer edge 65 provide a transition from the semi-circular portion 68 to the flat side 66 of the outer edge 65.

Note that the distance "D" must be sufficient so that the semi-circular portion 68 of the outer edge 65 of the collar 63 clears the block stop 81 when the lock bar 60 is in the unlocked position.

When the lock bar 60 is locked, the lock bar 60 is generally parallel to the flat side 66 of the collar 63 and the inner surface 83 of the block stop 81. If the collar 63 is urged to rotate in either direction indicated by directional arrow 73, one of the corners 70 or 71 will contact an inner side (not shown) of the lock bar 60 and prevent the collar 63 from further rotation, thus providing a positive lock to prevent the collar from rotation.

Figure 8:
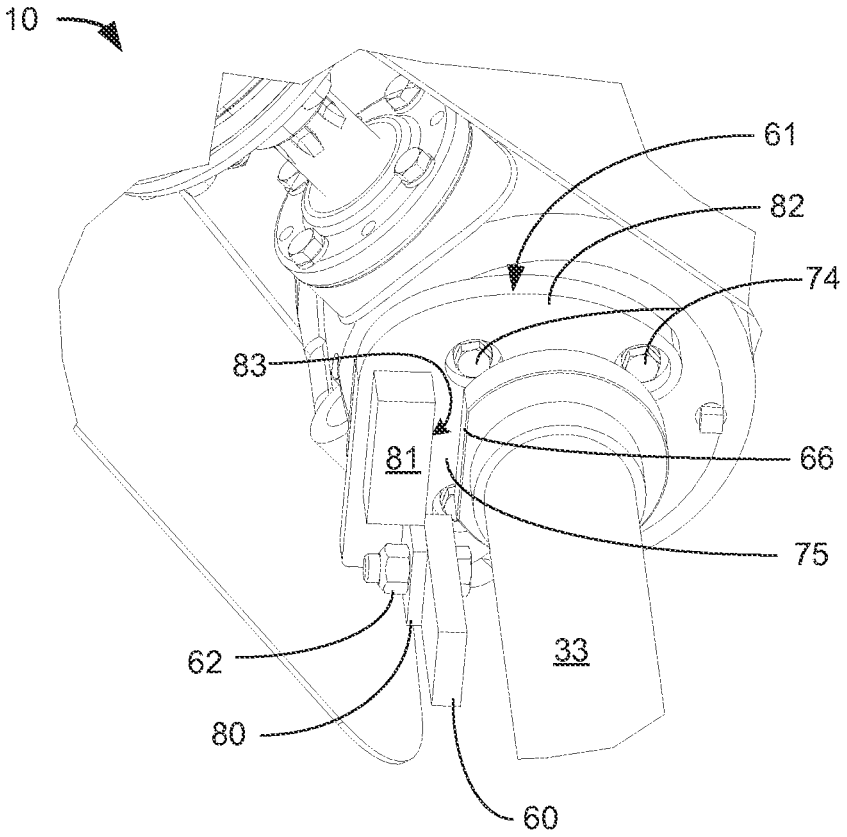
FIG. 8 is a partial enlarged bottom view of the digger of FIG. 6.

FIG. 8 is a partial enlarged view of the digger 10 showing a bottom perspective view of the gearbox 12. The block stop 81 is spaced apart from the flat side 66 of the collar 63 as discussed above, creating the gap 75. The lock bar 60 is disposed within the gap 75, and generally contacts the support plate 82 when the lock bar 60 is in the locked position.

The invention claimed is:

1. A gearbox lock mechanism for a post hole digger, the mechanism comprising:

a collar coupled to a lower end of a right angle gearbox, the collar rotatable upon operation of the gearbox, the collar comprising a semi-circular outer edge, the outer edge comprising a flat side;

a male-threaded nipple extending from the collar;

an auger shaft comprising female threads, the auger shaft releasably coupled to the male threaded nipple;

a lock bar coupled to the gearbox, the lock bar rotatable from a locked position whereby the lock bar is aligned with and contactable with the flat side of the outer edge of the collar, the lock bar rotatable to an unlocked position whereby the lock bar does not contact the flat side of the outer edge of the collar.

2. The mechanism of claim 1, wherein the nipple is unitary with the collar.

3. The mechanism of claim 1, further comprising a lock bar support, the lock bar support rigidly coupled to the gearbox between the gearbox and the collar, the lock bar rotatably coupled to the lock bar support via one or more fasteners.

4. The mechanism of claim 3, the lock bar support further comprising a support plate, the support plate comprising a generally flat plate coupled to the gearbox via a plurality of fasteners.

5. The mechanism of claim 4, the lock bar support further comprising a block stop rigidly affixed to the support plate adjacent to the lock bar when the lock bar is in the locked position, the block stop comprising a substantially rectangular box.

6. The mechanism of claim 5, the block stop substantially parallel to the flat side of the outer edge of the collar when the collar is locked, the block stop spaced apart from the flat side of the outer edge of the collar by a distance.

7. The mechanism of claim 6, wherein a width of the lock bar is slightly less than the distance, such that the lock bar fits between the flat side of the outer edge of the collar and the Hock stop when the lock bar is in the locked position.

8. A gearbox lock mechanism for a post hole digger, the mechanism comprising:

a collar extending beneath the gearbox, the collar rigidly affixed to a nipple that releasably affixes a shaft of the post hole digger to the gearbox, the collar rotatable upon operation of the gearbox, the collar comprising a semicircular outer edge, the outer edge primarily semicircular and the outer edge comprising a flat side;

a lock bar support rigidly coupled to an outer body of the gearbox, the outer body of the gearbox not rotatable upon operation of the gearbox;

a lock bar rotatably coupled to the lock bar support via a fastener, the lock bar extending downwardly from the lock bar support when the lock bar is in an unlocked position such that the post hole digger is operational, the lock bar positioned adjacent to and contactable with the flat side of the outer edge of the collar when the lock bar is in a locked position, thus preventing the shaft of the post hole digger from rotation.

9. The mechanism of claim 8, the lock bar support comprising a support plate, the support plate comprising a generally flat plate coupled to the outer body of the gearbox via a plurality of fasteners.

10. The mechanism of claim 9, the lock, bar support further comprising a block stop rigidly affixed to the support plate adjacent to the lock bar when the lock bar is in the locked position, the block stop comprising a substantially rectangular box.

11. The mechanism of claim 10, the block stop substantially parallel to the fiat side of the outer edge of the collar when the collar is locked, the block stop spaced apart from the flat side of the outer edge of the collar by a distance.

12. The mechanism of claim 11, wherein a width of the lock bar is slightly less than the distance, such that the lock bar fits between the flat side of the outer edge of the collar and the block stop when the lock bar is in the locked position.

13. A gearbox lock mechanism for a post hole digger, the mechanism comprising:

a collar coupled with a gearbox shaft and rotatable with the gearbox shaft, the collar comprising a flat side on its outer edge;

a rotatable lock bar engagable with the fiat side of the collar, the lock bar adjacent to and contacting the flat side when the lock bar is in a locked position, the lock bar preventing rotation of the gearbox shaft when the lock bar is in the locked position.

14. The mechanism of claim 13, further comprising a lock bar support, the lock bar support rigidly coupled to an outer body of the gearbox, the lock bar rotatably coupled to the lock bar support via one or more fasteners.

15. The mechanism of claim 14, the lock bar support further comprising a support plate, the support plate comprising a generally flat plate coupled to the gearbox via a plurality of fasteners.

16. The mechanism of claim 15, the lock bar support further comprising a block, stop rigidly affixed to the support plate adjacent to the lock bar when the lock bar is in the locked position, the block stop comprising a substantially rectangular box.

17. The mechanism of claim 16, the block stop substantially parallel to the flat side of the outer edge of the collar when the collar is locked, the block stop spaced apart From the flat side of the outer edge of the collar by a distance.

18. The mechanism of claim 17, wherein a width of the lock bar is slightly less than the distance, such that the lock bar fits between the flat side of the outer edge of the collar and the block stop when the lock bar is in the locked position.

* * * * *